United States Patent [19]

Takigawa et al.

[11] Patent Number: 4,862,645

[45] Date of Patent: Sep. 5, 1989

[54] CHAMFERING MACHINE

[75] Inventors: Shogo Takigawa; Masaru Izui, both of Kakogawa, Japan

[73] Assignee: Takigawa Kogyo Co., Ltd., Hyogo, Japan

[21] Appl. No.: 241,058

[22] Filed: Sep. 6, 1988

[30] Foreign Application Priority Data

Dec. 25, 1987 [JP] Japan ..... 62-327161

[51] Int. Cl.[4] ..... B24B 7/00

[52] U.S. Cl. ..... 51/81 R; 51/88

[58] Field of Search ..... 51/79, 78, 74 R, 72 R, 51/236, 81 R, 88, 117

[56] References Cited

FOREIGN PATENT DOCUMENTS

U.M.

55-53311 12/1980 Japan .

*Primary Examiner*—Frederick R. Schmidt

*Assistant Examiner*—Maurina Rachuba

*Attorney, Agent, or Firm*—Shapiro and Shapiro

[57] ABSTRACT

In a chamfering machine wherein a round bar material is longitudinally conveyed in the lengthwise direction thereof and is brought into contact with a grind stone for chamfering to chamfer an end surface of the round bar material and the round bar material is laterally conveyed in a direction orthogonal to the lengthwise direction thereof, a chamfering area including a conveying device for longitudinally conveying the round bar material, the grind stone for chamfering and a laterally conveying device is generally upwardly sloped.

10 Claims, 3 Drawing Sheets

CHAMFERING MACHINE

BACKGROUND OF THE INVENTION

1. Field of the Invention

This invention relates to a chamfering machine for effecting burring or chamfering of cut end surfaces of an elongate metal material of circular cross-section such as a bar or a tube.

2. Related Background Art

When an elongate metallic round bar or tube continuously manufactured is cut to a predetermined length, burr or the like sticks to the cut end surfaces thereof and therefore it need be removed. This burring is accomplished as by pushing the cut end surface of the elongate bar material against a rotating grind stone and rotating the bar material, whereby the bar material has its end edge smoothly ground concentrically.

The force with which an elongate "round bar material" (it is to be understood that this term covers a bar and a tube having a circular cross-section) is pushed against a rotating grind stone must be chosen to a predetermined magnitude, and must not be too strong or too weak. Further, the end edge of the round bar material need be ground over its full periphery and therefore, simultaneously with the pushing force, a rotational force must be imparted to the round bar material.

Heretofore, such a kind of work has been difficult to mechanize, and even mechanized works have hardly satisfied the subtle force relation required. Among the examples of the prior art, the chamfering machine proposed by the applicant (Japanese Utility Model Registration No. 1394371 (German Patent DE No. 2921345C2)) is an example which has overcome the difficulty in mechanization.

In the above-mentioned applicant's chamfering machine, a plurality of rollers of a conveying device for longitudinally conveying an elongate round bar material (conveying a round bar material in the lengthwise direction thereof) are disposed obliquely with respect to the axis of the conveying device. These obliquely disposed rollers are adapted to cooperate with a conveying device for laterally conveying the round bar material and a rotating grind stone to act. That is, when the obliquely disposed rollers are rotated, a force which pushes the round bar material lying thereon in the lengthwise direction thereof and a force which induces the rotation thereof are imparted to the round bar material by friction. By the cooperation of these forces with the laterally conveying device and the rotating grind stone, the end portion of the round bar material is rotated and laterally conveyed while being pushed against the rotating grind stone and thus, burring and chamfering of the end surface is accomplished.

The operation of chamfering the end portion of the round bar material by the machine of the above-mentioned Japanese Utility Model Registration No. 1394371 has suffered from the following disadvantages and has left room for improvement. Where as in the above-described machine, a round bar material is moved by obliquely disposed longitudinally conveying rollers and a transfer conveyor having the dogs of a laterally conveying device, if the longitudinally conveying rollers and the laterally conveying transfer conveyor are installed generally horizontally or downwardly sloped, the round bar material has sometimes run away from the dogs and rolled when it is laterally conveyed by being pushed by the dogs.

Also, in the above-described machine, the longitudinally conveying rollers are disposed in two rows and between these rows of conveying rollers, there is an intermediate conveying roller for aligning the round bar material in the lengthwise or longitudinal direction thereof and moving it to chamfer the both end surfaces of the round bar material in succession. During the longitudinal movement of the round bar material by this intermediate conveying roller, the round bar material is moved in a direction perpendicular to the movement of the dogs while being in contact with the dogs of the laterally conveying device. Accordingly, if the dogs are merely fixed fittings such as short posts, the end portion of the round bar material may collide against them.

Further, if the dogs are of the fixed type, when the dogs contact with the round bar material and laterally conveys the latter, the friction between the two is great and therefore, forward rolling of the round bar material is liable to occur.

SUMMARY OF THE INVENTION

The present invention has been made in view of the above-noted circumstances, and a first object thereof is to provide a chamfering machine in which the chamfering work including a transfer conveyor having the obliquely disposed rollers of a longitudinally conveying device and the dogs of a laterally conveying device, an intermediate conveying roller and a rotatable grind stone for chamfering can be effected even in a sloped place.

A second object of the present invention is to mount the dogs of the transfer conveyor of the laterally conveying device in such a manner that no unreasonable force is applied to holding metal.

To achieve the above objects, in the present invention, the area for chamfering work is upwardly sloped and the dogs of the transfer conveyor are of the free roller type.

By adopting such a construction, a round bar material is reliably rotated while being always in intimate contact with the dogs of the transfer conveyor of the laterally conveying device and is laterally conveyed without being forwardly conveyed.

Also, by the dogs of the transfer conveyor being of the free roller type, the contact resistance between the dogs and the round bar material is decreased when the round bar material is moved in the longitudinal (lengthwise) direction thereof.

Further, if the free roller type dogs are mounted on the holding metal of the conveyor of the laterally conveying device with the axes thereof inclined with respect to said conveyor in a plane transverse to the direction of movement of said conveyor (this inclination is also an inclination with respect to the direction of lengthwise movement of the round bar material, friction will be decreased by the rotation of the free rollers of the dogs when the fore end of the round bar material strikes against the dogs, and the collision will be remarkably alleviated even if it occurs.

When the end surface of the round bar material is chamfered by the round bar material being passed with the fore end thereof bearing against the rotating grind stone in this manner, the rotating operation of the round bar material and the pushing operation of the round bar material toward the grind stone caused by the action of obliquely disposed rollers become reliable and increased as compared with the example of the prior art which lacks such means, whereby the working property of chamfering is improved.

BRIEF DESCRIPTION DRAWINGS

FIG. 1 is a plan view showing an embodiment of the chamfering of the present invention.

FIG. 2 a side view of the machine of the FIG. 1.

FIG. 3 is a view illustrating the movements of each conveying device and a round bar material with respect to a second group of conveying rollers of a longitudinally conveying device.

DESCRIPTION OF THE PREFERRED EMBODIMENT

A preferred embodiment of the present invention will hereinafter be described with reference to the drawings, but it should be understood that the present invention is not restricted thereto.

Figure 1:
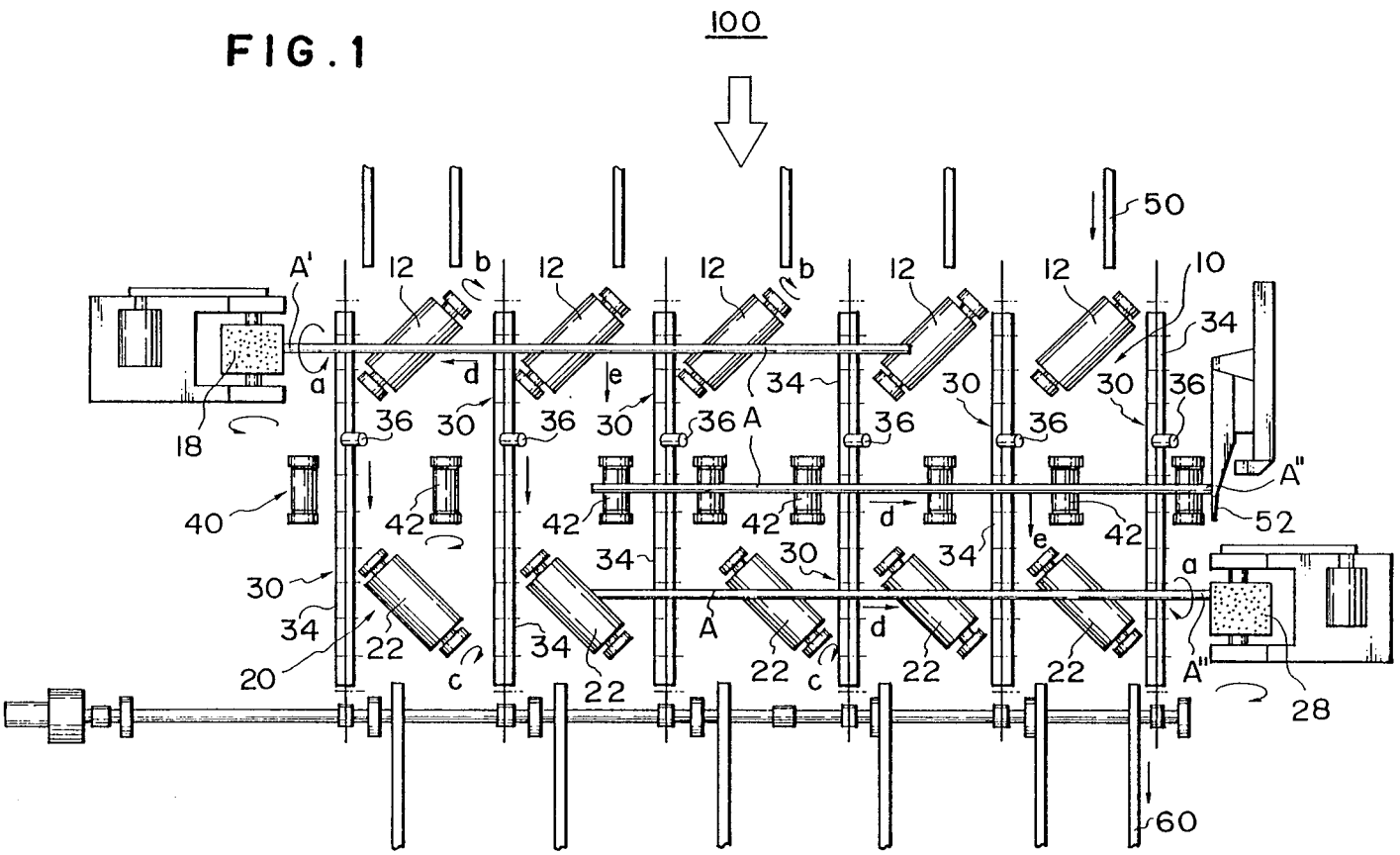
Figure 2:
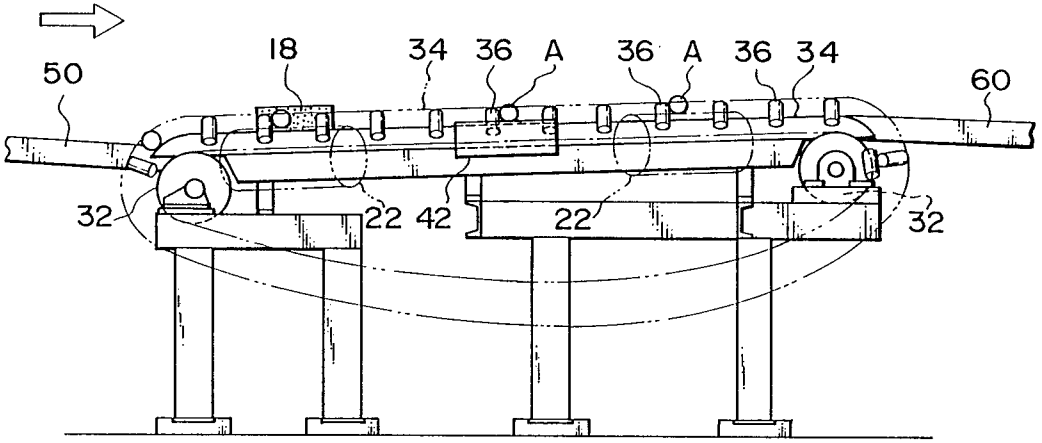

FIG. 1 is a schematic plan view showing an embodiment of the present invention, and FIG. 2 is a side view as seen from the left of FIG. 1. In these Figures, the reference numeral 100 generally designates a chamfering machine which comprises a pair of longitudinally conveying devices 10 and 20 for longitudinally moving elongate round bar materials A thereon, a carrying-in device 50 and a carrying-out device 60 for carrying in and carrying out the round bar material A, a laterally conveying device 30 for forcibly laterally feeding the round bar material on rollers between the carrying-in device 50 and the carrying-out device 60, and grind stones 18 and 28 for grinding the end surfaces of the round bar materials A.

The longitudinally conveying devices 10 and 20 are disposed parallel to each other and respectively comprise a plurality of conveying rollers 12 and a plurality of conveying rollers 22. In FIG. 1, the rollers 12 constituting the upper (in the FIG. 1) conveying device 10 are rotated synchronously in a direction indicated by arrow b by a drive shaft (not shown) or individual drive shafts. The conveying rollers 12 are disposed so that they are oblique with respect to the axis of the conveying device 10 itself, in other words, they are oblique with respect to the lengthwise direction of the elongate round bar material A supplied in the axial direction of the conveying device 10. Thus, the elongate round bar material A supplied on the conveying device 10 by a conveying device to be described is moved in the axial direction thereof (to the left as viewed in FIG. 1) toward the grind stone 18. Rotation as indicated by arrow a is imparted to the round bar material A by the conveying rollers 12.

The conveying rollers 22 constituting the lower (in the FIG. 1) conveying device 20, like the previously described conveying rollers 12, are disposed so as to be oblique with respect to the axis of the conveying device 20 itself, and are rotated in the direction of arrow c. Accordingly, the rollers 22 move the elongate round bar material A thereon toward the grind stone 28 and rotate the round bar material A in the direction of arrow a similarly to what has been previously described.

The grind stone 18 is disposed in proximity to the end portion of the conveying device 10, and the grind stone 28 is disposed in proximity to the end portion of the conveying device 20, and both of them are always rotating.

It is for the purpose of chamfering the end portions A′ and A″ of both of the elongate round bar materials A that the rollers 12 and 22 of the two longitudinally conveying devices 10 and 20 and the two grind stones 18 and 28 are disposed thus. The rollers 12 of the conveying device 10 convey the round bar material A to the left as viewed in FIG. 1, and the rollers 22 of the conveying device 20 convey the round bar material A to the right as viewed in FIG. 1, and the directions of conveyance thereof are opposite to each other. Accordingly, the directions of oblique disposition and the directions of rotation of the rollers 12 and the rollers 22 are opposite to each other. However, in the other points, these rollers are operationally similar and therefore, hereinafter, the device 10 will be described chiefly.

The laterally conveying device 30 comprises dogs 36 mounted at predetermined intervals on an endless conveyor chain 34 passed over a pair of sprocket 32 shown in FIG. 2 and moved round for laterally feeding the round bar material A. This laterally conveying device 30 is used to convey the round bar material A onto the rollers 12 of the longitudinally conveying device 10, laterally convey the round bar material to pass over the rollers 12, and further convey the round bar material from the rollers 12 of the longitudinally conveying device 12. As is apparent from FIG. 1, the conveying rollers 12 of the conveying device 10 are disposed obliquely with respect also to the conveyor chain 34.

An intermediate conveying device 40 has its axis generally extending parallel to the axes of the conveying devices 10 and 30 and is disposed between the conveying device 10 and 20, and comprises a plurality of intermediate rollers 42 having their axes made parallel to the direction in which the chain 34 extends. This intermediate conveying device 40 is for causing the elongate round bar A urged toward the grind stone 18 on the conveying device 10 of FIG. 1 to move in the direction opposite thereto, i.e., toward the grind stone 28.

A stopper 52 is disposed in proximity to one end of the intermediate conveying device 40, and the round bar material A comes near the grind stone 28 due to the cooperation between the intermediate conveying device 40 and the laterally conveying device 30, and is once stopped from moving lengthwise by the stopper 52, and then is transferred onto the conveying device 20.

A laterally conveying device 50 for supplying the round bar material A is disposed on this side of (as viewed in FIG. 1, above) the longitudinally conveying device 10, and a laterally conveying device 60 for discharging the round bar material A is disposed on that side of (as viewed in FIG. 1, below) the conveying device 20. The elongate round bar material A is supplied or carried in from above as viewed in FIG. 1 by the conveying device 10, and is set on the chain 34 of the conveying device 30.

The velocities of the rollers and chain of the respective conveying devices are predetermined in conformity with the dimensions and quality of the round bar material A to be chamfered.

The round bar material A is supplied between the adjacent dogs 36 of the laterally conveying device 30 by the laterally conveying device 50 for supplying the round bar material. When the round bar material A comes onto the rollers 12 of the conveying device 10, as previously described, a thrust for moving the round bar material A toward the grind stone 18 for chamfering and a rotational force for rotating the round bar material A about its axis are imparted to the round bar material A by the rollers 12. Also at this time, the round bar material A is being laterally conveyed by the chain 34 and dogs 36 of the laterally conveying device 30. Thus, when one end A' (the left end as viewed in FIG. 1) of the round bar material A arrives at the grind stone 18, that end surface of the round bar material A is immediately ground by the grind stone 18.

What should be noted about the construction of the present embodiment is that the chamfering work area including the conveyor chain 34 having the dogs 36 of the laterally conveying device 30, the obliquely disposed rollers 12 of the longitudinally conveying device 10, the rollers 42 of the intermediate conveying device 40 and the grind stones 18 and 28 for chamfering is upwardly sloped or inclined. That is, as is apparent from FIG. 2, there is provided an upward slope or inclination of about 2° from the rollers 12 of the conveying device 10 to the rollers 42 of the intermediate conveying device 40.

If the chamfering work area is thus upwardly sloped, the round bar material A is always urged against the dogs 46 of the laterally feeding conveyor chain 44 and is laterally conveyed in that state. Accordingly, a situation in which the round bar material A rolls away from the dogs 46 is avoided.

Figure 3:
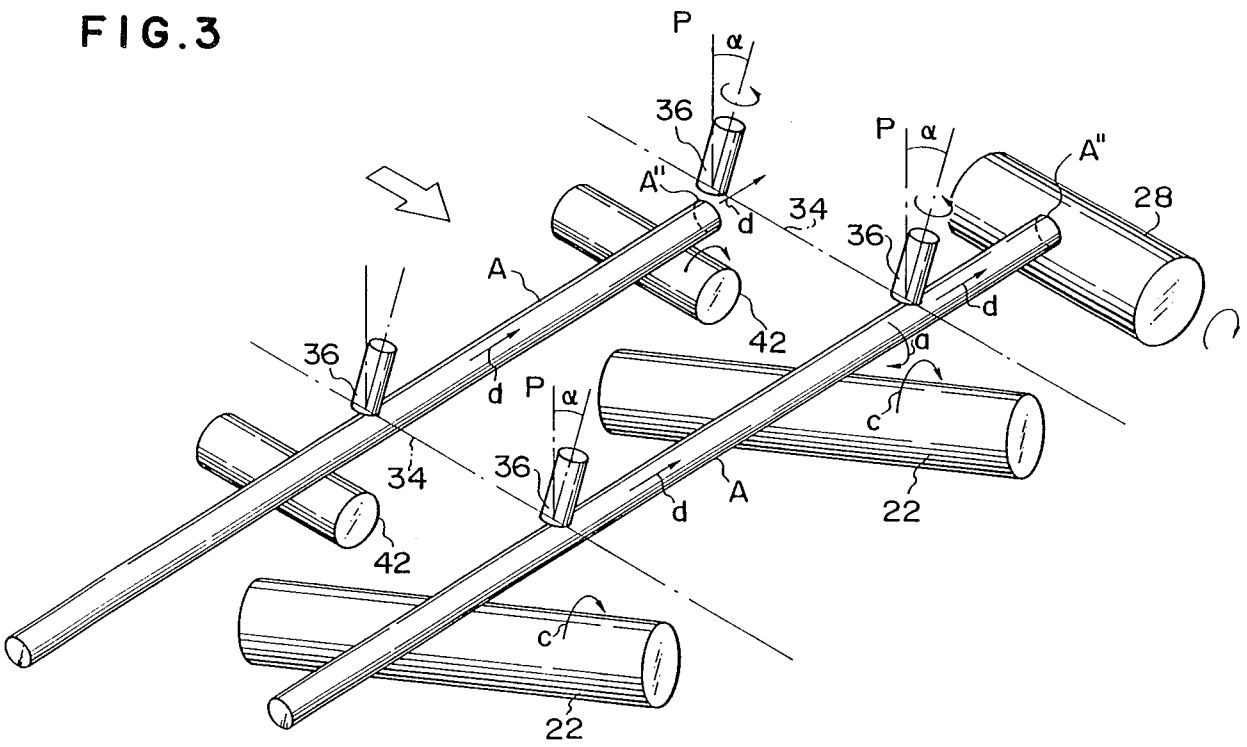

What should further be noted about the construction of the present embodiment is that the dogs 36 mounted on the conveyor chain 34 of the laterally conveying device 30 are rotatable about the axes thereof (free roller type) and that the dogs 36 are mounted on the holding metal of the conveyor chain 34 with the axes thereof inclined (at an angle $\alpha$) in a plane orthogonal or transverse to the direction of movement of the conveyor chain 34 (see FIG. 3).

According to such construction, the engagement between the round bar material A and the dogs 36 is rolling friction and therefore, three kinds of motions, i.e., the rotation (a) transmitted from the rollers 12 and dogs 36 to the round bar material A (by contact therebetween), lengthwise propulsion (d) and lateral feed (e) are all effected through the rolling friction. By the cooperation between these three kinds of motions, the fore end A' of the round bar material A is pushed against the grind stone 18 for chamfering and rotated and fed laterally, whereby grinding or chamfering of the fore end A' of the round bar material is accomplished. Thereby, the contact between the fore end A' of the round bar material A and the rotatable grind stone 18 is effected smoothly and reasonably and thus, chamfering of the fore end of the round bar material A is accomplished conveniently.

Where the chamfering of one end A' portion of the round bar material A suffices, the round bar material A chamfered by the above-described process is directly transferred onto the laterally conveying device 60 by the laterally conveying device 30 and leaves the work area of the chamfering machine.

In contrast therewith, if the chamfering of the both end portions A' and A" of the round bar material A is required, the longitudinally conveying device 20 and the intermediate conveying device 40 are utilized. The chamfering work area including the rollers 42 of the intermediate conveying device 40, the rollers 22 of the longitudinally conveying device 20, the grind stone 18 for chamfering and the laterally conveying device 30 is upwardly sloped from the intermediate conveying device 40 toward the conveying device 20 (see FIG. 2).

As shown in FIG. 3, the dogs 36 mounted on the conveyor chain 34 of the laterally conveying device 30 have their axes inclined by an angle $\alpha$ lengthwisely of the round bar material A in a plane orthogonal to the direction of movement of the conveyor chain 34. That is, in said plane, the axes of the dogs 36 are inclined by the angle $\alpha$ with respect to the perpendicular P in the direction d in which the round bar material A is pushed toward the grind stone 28.

The round bar material A having had one end A' thereof thus chamfered need be conveyed lengthwisely toward the rotatable grind stone 28 by the rollers 42 of the intermediate conveying device 40 in order that the other end A" of the round bar material may be chamfered. In this case, the round bar material A is laterally conveyed at the same time by the dogs 36 of the laterally conveying device 30. Thus, the fore end A" of the round bar material A contacts with one of the dogs 36. However, since the dogs 36 are constructed as free rollers, no unreasonable force acts between the round bar material and said one dog at this time, and said one dog 36 is rotated by said contact. That is, rolling friction only occurs between the round bar material A and said one dog 36.

When the round bar material A is thus brought onto the rollers 22 of the longitudinally conveying device 20, rotation in the direction of arrow a and propulsion in the direction of arrow d are imparted to the round bar material A because the conveying rollers 22 are rotating in the direction of arrow c, and further the round bar material A is laterally conveyed by the dogs 36 of the laterally conveying device 30.

Accordingly the round bar material A has its fore end A" urged against the rotatable grind stone 28 for chamfering while being rotated and is laterally conveyed, whereby the fore end A" is ground and chamfered. The chamfering of the fore end A" of the round bar material A is conveniently accomplished because the entire chamfering area is upwardly sloped. Moreover, in this case, the direction of inclination of the free roller type dogs 36 on the conveyor chain 34 of the laterally conveying device 30 is made coincident with the direction of longitudinal conveyance of the round bar material A, and this is also convenient during the longitudinal conveyance of the round bar material A.

When the chamfering of the both end portions of the round bar material A is completed in this manner, the round bar material A is further conveyed laterally by the laterally conveying device 30, is transferred onto the laterally conveying device 60 and leaves the chamfering area of the chamfering machine.

The speeds of operation of the laterally conveying devices 50 and 60 for supplying and carrying-out, the laterally conveying device 30, the longitudinally conveying devices 10 and 20 and the intermediate conveying device 40 can be freely adjusted in conformity with the situation of chamfering and grinding and the situation of flow of the process line.

As described above, according to the present invention, the round bar material A has its end portions A' and A" reliably urged against the rotatable grind stones and is laterally conveyed while rotating and therefore, chamfering of the end portions of the round bar material is accomplished conveniently and efficiently. Also, in connection with this good efficiency, the length of the rotatable grind stones can be shortened and the driving power therefor can be decreased. Further, as a result, the size of the entire chamfering machine can be made small. This also leads to a reduction in the cost of the facilities and a decrease in the space for installation, which in turn leads to an economical advantage.

We claim:

1. A chamfering machine for chamfering one end surface of a round bar material, including:

a longitudinally conveying device for longitudinally conveying the round bar material in the axial direction thereof while rotating the round bar material;

a grind stone for chamfering disposed forwardly in the direction of conveyance of said longitudinally conveying device; and a laterally conveying device disposed so as to be orthogonal to said longitudinally conveying device for laterally conveying the round bar material lying on said longitudinally conveying device in a direction substantially perpendicular to the lengthwise direction thereof;

a chamfering area being upwardly sloped from said longitudinally conveying device toward the front in the direction of conveyance of said laterally conveying device.

2. A chamfering machine according to claim 1, wherein said laterally conveying device includes a rotatively driven endless belt-like member and a plurality of engaging members secured at predetermined intervals thereon and engageable with the round bar material,-,each of said engaging members being rotatable about the axis thereof.

3. A chamfering machine according to claim 2, wherein said rotatable engaging members are inclined in the direction of longitudinal conveyance of the round bar material in a plane orthogonal to the direction of conveyance of said laterally conveying device.

4. A chamfering machine according to claim 1, wherein said longitudinally conveying device includes a plurality of conveying rollers capable of supporting the round bar material, each of said conveying rollers having one end thereof positioned and inclined more to the front in the direction of conveyance than the other end to impart a rotational force and an axial thrust to the round bar material.

5. A chamfering machine for chamfering the both end surfaces of a round bar material, including:

a first longitudinally conveying device for longitudinally conveying the round bar material in one axial direction thereof while rotating the round bar material;

a first grind stone for chamfering disposed forwardly in the direction of conveyance of said first longitudinally conveying device;

a second longitudinally conveying device disposed parallel to said first longitudinally conveying device for longitudinally conveying the round bar material in the other axial direction thereof while rotating the round bar material;

a second grind stone for chamfering disposed forwardly in the direction of conveyance of said second longitudinally conveying device;

an intermediate conveying device disposed parallel to said first longitudinally conveying device and said second longitudinally conveying device therebetween for moving the round bar material in the other axial direction thereof; and a laterally conveying device disposed so as to be orthogonal to said first and second longitudinally conveying device and said intermediate conveying device for laterally conveying the round bar material in a direction perpendicular to the axial direction thereof between said first longitudinally conveying device and said intermediate conveying device and between said intermediate conveying device and said second longitudinally conveying device;

a chamfering area including said first longitudinally conveying device, said intermediate conveying device, said second longitudinally conveying device, said laterally conveying device and said first and second grind stones for chamfering being upwardly sloped from said first longitudinally conveying device toward said second longitudinally conveying device.

6. A chamfering machine according to claim 5, wherein said laterally conveying device includes a rotatively driven endless belt-like member and a plurality of engaging members secured at predetermined intervals thereon and engageable with the round bar material, each of said engaging members being rotatable about the axis thereof.

7. A chamfering machine according to claim 6, wherein said rotatable engaging members are inclined in the direction of longitudinal conveyance of the round bar material in a plane orthogonal to the direction of conveyance of said laterally conveying device.

8. A chamfering machine according to claim 6, wherein said longitudinally conveying devices include a plurality of conveying rollers capable of supporting the round bar material, each of said conveying rollers having one end thereof positioned and inclined more to the front in the direction of conveyance than the other end to impart a rotational force and an axial thrust to the round bar material.

9. A chamfering machine according to claim 6, wherein a carrying-in device for carrying the round bar material in a direction perpendicular to the lengthwise direction thereof is disposed on this side of said first longitudinally conveying device, and a carrying-out device for the round bar material is disposed on that side of said second longitudinally conveying device.

10. A chamfering machine according to claim 6, wherein a stopper for restricting the advancement of the round bar material is provided at the fore end portion in the direction of conveyance of said intermediate conveying device.

* * * * *